US009229387B2

(12) United States Patent
Sasaki et al.

(10) Patent No.: US 9,229,387 B2
(45) Date of Patent: Jan. 5, 2016

(54) FIXING APPARATUS WITH A CONTROL UNIT FOR POWERING A FIXING HEATER USING A COMBINATION OF CONTROL PATTERNS, AND IMAGE-FORMING APPARATUS USING THE SAME

(71) Applicant: Konica Minolta, Inc., Tokyo (JP)

(72) Inventors: Kosuke Sasaki, Kanagawa-ken (JP); Kenji Tamaki, Saitama-ken (JP); Masayuki Watanabe, Tokyo (JP); Kiyoto Kojima, Tokyo (JP); Kenji Izumiya, Tokyo (JP); Hiroshi Oyama, Tokyo (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 14/658,751

(22) Filed: Mar. 16, 2015

(65) Prior Publication Data

US 2015/0268593 A1 Sep. 24, 2015

(30) Foreign Application Priority Data

Mar. 19, 2014 (JP) ..... 2014-056240

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/69
See application file for complete search history.

(56) References Cited

U.S. PATENT DOCUMENTS 7,212,760 B2 * 5/2007 Yokono ..... 399/69
2010/0166446 A1 * 7/2010 Naganawa et al. ..... 399/69

FOREIGN PATENT DOCUMENTS

JP 2000-347530 12/2000
JP 2005032558 A * 2/2005

* cited by examiner

*Primary Examiner* — Susan Lee
(74) *Attorney, Agent, or Firm* — Squire Patton Boggs (US) LLP

(57) ABSTRACT

A fixing apparatus included in an image forming apparatus includes a fixing heater that performs heat fixing, a control unit that controls the fixing heater based on control patterns, a temperature sensor that detects temperature of the fixing heater, and a voltage detection unit that detects a voltage that is applied to the fixing heater. In each control pattern, turn-on period of the fixing heater and turn-off period of the fixing heater are set according to a control cycle of a half cycle duty control. The control unit controls the switching unit to turn on or off the fixing heater using a combination of the control patterns each satisfying a standard for preventing a flicker during each control period of time that is integral multiplication of the control cycle according to the temperature of the fixing heater and the voltage value allied to the fixing heater.

8 Claims, 19 Drawing Sheets

| CONTROL CYCLE | NUMBER OF TURN-ON | HEATER TURN-ON DUTY | POWER W | STANDARD |
|---|---|---|---|---|
| 1 | 0 | 0% | 0W | OK(AVAILABLE) |
| 3 | 1 | 33% | 333W | OK(AVAILABLE) |
| 2 | 1 | 50% | 500W | NG(UNAVAILABLE) |
| 3 | 2 | 67% | 667W | OK(AVAILABLE) |
| 1 | 1 | 100% | 1,000W | OK(AVAILABLE) |

FIG. 5

| POWER TO BE SUPPLIED W | HEATER APPLIED VOLTAGE V | | | | |
|---|---|---|---|---|---|
| | 160 | 180 | 200 | 220 | 240 |
| 0 | 0.00% | 0.00% | 0.00% | 0.00% | 0.00% |
| 100 | 10.00% | 7.90% | 6.40% | 5.29% | 4.44% |
| 200 | 20.00% | 15.80% | 12.80% | 10.58% | 8.89% |
| 300 | 30.00% | 23.70% | 19.20% | 15.87% | 13.33% |
| 400 | 40.00% | 31.60% | 25.60% | 21.16% | 17.78% |
| 500 | 50.00% | 39.51% | 32.00% | 26.45% | 22.22% |
| 600 | 60.00% | 47.41% | 38.40% | 31.74% | 26.67% |
| 700 | 70.00% | 55.31% | 44.80% | 37.02% | 31.11% |
| 800 | 80.00% | 63.21% | 51.20% | 42.31% | 35.56% |
| 900 | 90.00% | 71.11% | 57.60% | 47.60% | 40.00% |
| 1000 | 100.00% | 79.01% | 64.00% | 52.89% | 44.44% |

FIG. 6

RELATED ART

P10a
D10
P10
P10b

| POWER TO BE SUPPLIED W | HEATER APPLIED VOLTAGE V | | | | |
|---|---|---|---|---|---|
| | 160 | 180 | 200 | 220 | 240 |
| 0 | 0 | 0 | 0 | 0 | 0 |
| 100 | 1/11(9.09) | 1/11(9.09) | 1/11(9.09) | 1/11(9.09) | 1/11(9.09) |
| 200 | 1/5(20.00) | 2/11(18.18) | 1/9(11.11) | 1/9(11.11) | 1/11(9.09) |
| 300 | 2/7(28.57) | 2/9(22.22) | 1/5(20.00) | 1/7(14.29) | 1/7(14.29) |
| 400 | 2/5(40.00) | 1/3(33.33) | 3/11(27.27) | 2/9(22.22) | 2/11(18.18) |
| 500 | 5/11(45.45) | 4/11(36.36) | 1/3(33.33) | 3/11(27.27) | 2/9(18.18) |
| 600 | 3/5(60.00) | 5/11(45.45) | 4/11(36.36) | 1/3(33.33) | 3/11(27.27) |
| 700 | 5/7(71.43) | 6/11(54.55) | 4/9(44.44) | 4/11(36.36) | 1/3(33.33) |
| 800 | 4/5(80.00) | 7/11(63.64) | 6/11(54.55) | 3/7(42.86) | 4/11(36.36) |
| 900 | 10/11(90.01) | 5/7(71.43) | 4/7(57.14) | 5/11(45.45) | 2/5(40.00) |
| 1000 | 1/1(100) | 7/9(77.78) | 7/11(63.64) | 6/11(54.55) | 4/9(44.44) |

FIG. 7

P1a
P1b
P1
D1

| POWER TO BE SUPPLIED W | HEATER APPLIED VOLTAGE V | | | | |
|---|---|---|---|---|---|
| | 160 | 180 | 200 | 220 | 240 |
| 0 | 0 | 0 | 0 | 0 | 0 |
| 100 | 1/10(10.00) | 8/100(8.00) | 6/100(6.00) | 1/20(5.00) | 1/20(4.00) |
| 200 | 1/5(20.00) | 9/50(18.00) | 13/100(13.00) | 11/100(11.00) | 9/100(9.00) |
| 300 | 3/10(30.00) | 27/100(27.00) | 19/100(19.00) | 4/25(16.00) | 13/100(13.00) |
| 400 | 2/5(40.00) | 9/25(36.00) | 13/50(26.00) | 21/100(21.00) | 9/50(18.00) |
| 500 | 1/2(50.00) | 11/25(44.00) | 8/25(32.00) | 13/50(26.00) | 11/50(22.00) |
| 600 | 3/5(60.00) | 53/100(53.00) | 19/50(38.00) | 8/25(32.00) | 27/100(27.00) |
| 700 | 7/10(70.00) | 31/50(62.00) | 9/20(45.00) | 37/100(37.00) | 31/100(31.00) |
| 800 | 4/5(80.00) | 71/100(71.00) | 51/100(51.00) | 21/50(42.00) | 9/25(36.00) |
| 900 | 9/10(90.00) | 4/5(80.00) | 29/50(58.00) | 12/25(48.00) | 10/25(40.00) |
| 1000 | 1/1(100) | 9/10(90.00) | 64/100(64.00) | 53/100(53.00) | 11/25(44.00) |

FIG. 8A

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 1% | 1 | 1 | 0 | 0 | 0 | 0 | 0 | 0 | 0 | 0 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 2% | 1 | 1 | 0 | 0 | 0 | 0 | 0 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 3% | 3 | 1 | 1 | 1 | 0 | 0 | 0 | 0 | 0 | 0 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 4% | 1 | 1 | 0 | 0 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 5% | 1 | 1 | 0 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 6% | 3 | 1 | 1 | 1 | 0 | 0 | 0 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 7% | 7 | 1 | 1 | 1 | 1 | 1 | 1 | 1 | 0 | 0 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 8% | 2 | 1 | 1 | 0 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |

FIG. 8B

| HEATER TURN-ON DUTY (FRACTION REPRESENTATION) | | CON-TROL PAT-TERN 1 | CON-TROL PAT-TERN 2 | CON-TROL PAT-TERN 3 | CON-TROL PAT-TERN 4 | CON-TROL PAT-TERN 5 | CON-TROL PAT-TERN 6 | CON-TROL PAT-TERN 7 | CON-TROL PAT-TERN 8 | CON-TROL PAT-TERN 9 | CON-TROL PAT-TERN 10 | |
|---|---|---|---|---|---|---|---|---|---|---|---|---|
| 9% | 9 | 1 | 1 | 1 | 1 | 1 | 1 | 1 | 1 | 1 | 0 | NUMER-ATOR (NUMBER OF HEATER TURN-ON) |
| | 100 | 11 | 11 | 11 | 11 | 11 | 11 | 11 | 11 | 9 | 3 | DENOMI-NATOR (CONTROL CYCLE) |
| 10% | 1 | 1 | 0 | – | – | – | – | – | – | – | – | NUMER-ATOR (NUMBER OF HEATER TURN-ON) |
| | 10 | 7 | 3 | – | – | – | – | – | – | – | – | DENOMI-NATOR (CONTROL CYCLE) |
| 11% | 11 | 2 | 2 | 1 | 1 | 1 | 1 | 1 | 1 | 1 | 0 | NUMER-ATOR (NUMBER OF HEATER TURN-ON) |
| | 100 | 11 | 11 | 11 | 11 | 11 | 11 | 11 | 11 | 9 | 3 | DENOMI-NATOR (CONTROL CYCLE) |
| 12% | 3 | 2 | 1 | 0 | – | – | – | – | – | – | – | NUMER-ATOR (NUMBER OF HEATER TURN-ON) |
| | 25 | 11 | 11 | 3 | – | – | – | – | – | – | – | DENOMI-NATOR (CONTROL CYCLE) |
| 13% | 13 | 2 | 2 | 2 | 2 | 1 | 1 | 1 | 1 | 1 | 0 | NUMER-ATOR (NUMBER OF HEATER TURN-ON) |
| | 100 | 11 | 11 | 11 | 11 | 11 | 11 | 11 | 11 | 9 | 3 | DENOMI-NATOR (CONTROL CYCLE) |
| 14% | 7 | 2 | 2 | 2 | 1 | 0 | 0 | – | – | – | – | NUMER-ATOR (NUMBER OF HEATER TURN-ON) |
| | 50 | 11 | 11 | 11 | 11 | 3 | 3 | – | – | – | – | DENOMI-NATOR (CONTROL CYCLE) |
| 15% | 3 | 2 | 1 | – | – | – | – | – | – | – | – | NUMER-ATOR (NUMBER OF HEATER TURN-ON) |
| | 20 | 11 | 9 | – | – | – | – | – | – | – | – | DENOMI-NATOR (CONTROL CYCLE) |
| 16% | 4 | 2 | 2 | 0 | – | – | – | – | – | – | – | NUMER-ATOR (NUMBER OF HEATER TURN-ON) |
| | 25 | 11 | 11 | 3 | – | – | – | – | – | – | – | DENOMI-NATOR (CONTROL CYCLE) |

FIG. 8C

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 17% | 17 | 2 | 2 | 2 | 2 | 2 | 2 | 2 | 2 | 1 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 18% | 9 | 3 | 3 | 2 | 2 | 0 | 0 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 19% | 19 | 3 | 2 | 2 | 2 | 2 | 2 | 2 | 2 | 2 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 20% | 1 | 1 | – | – | – | – | – | – | – | – | – | NUMERATOR (NUMBER OF HEATER TURN-ON) |
| | 5 | 5 | – | – | – | – | – | – | – | – | – | DENOMINATOR (CONTROL CYCLE) |
| 21% | 21 | 3 | 3 | 3 | 2 | 2 | 2 | 2 | 2 | 2 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 22% | 11 | 3 | 3 | 2 | 2 | 0 | 0 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 23% | 23 | 3 | 3 | 3 | 3 | 3 | 2 | 2 | 2 | 2 | 0 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 24% | 6 | 3 | 3 | 0 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 25% | 2 | 1 | 1 | – | – | – | – | – | – | – | – | NUMERATOR (NUMBER OF HEATER TURN-ON) |
| | 8 | 5 | 3 | – | – | – | – | – | – | – | – | DENOMINATOR (CONTROL CYCLE) |

FIG. 8D

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 26% | 13 | 3 | 3 | 3 | 3 | 1 | 0 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 27% | 27 | 3 | 3 | 3 | 3 | 3 | 3 | 3 | 3 | 2 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 28% | 7 | 3 | 3 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 29% | 29 | 4 | 3 | 3 | 3 | 3 | 3 | 3 | 3 | 3 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 30% | 3 | 2 | 1 | – | – | – | – | – | – | – | – | NUMERATOR (NUMBER OF HEATER TURN-ON) |
| | 10 | 7 | 3 | – | – | – | – | – | – | – | – | DENOMINATOR (CONTROL CYCLE) |
| 31% | 31 | 4 | 4 | 4 | 3 | 3 | 3 | 3 | 3 | 3 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 32% | 8 | 4 | 3 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 33% | 33 | 4 | 4 | 4 | 4 | 4 | 3 | 3 | 3 | 3 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |

FIG. 8E

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 34% | 17 | 4 | 4 | 4 | 3 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 35% | 7 | 4 | 3 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 36% | 9 | 4 | 4 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 37% | 37 | 4 | 4 | 4 | 4 | 4 | 4 | 4 | 4 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 38% | 19 | 5 | 4 | 4 | 4 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 39% | 39 | 5 | 5 | 4 | 4 | 4 | 4 | 4 | 4 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 40% | 2 | 2 | – | – | – | – | – | – | – | – | – | NUMERATOR (NUMBER OF HEATER TURN-ON) |
| | 5 | 5 | – | – | – | – | – | – | – | – | – | DENOMINATOR (CONTROL CYCLE) |
| 41% | 41 | 5 | 5 | 5 | 5 | 4 | 4 | 4 | 4 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |

FIG. 8F

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 42% | 21 | 5 | 5 | 5 | 4 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 43% | 43 | 5 | 5 | 5 | 5 | 5 | 5 | 4 | 4 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 44% | 11 | 5 | 5 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 45% | 9 | 5 | 4 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 46% | 23 | 6 | 5 | 5 | 5 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 47% | 47 | 6 | 6 | 5 | 5 | 5 | 5 | 5 | 5 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 48% | 12 | 6 | 5 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 49% | 49 | 6 | 6 | 6 | 6 | 5 | 5 | 5 | 5 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 50% | 3 | 2 | 1 | – | – | – | – | – | – | – | – | NUMERATOR (NUMBER OF HEATER TURN-ON) |
| | 6 | 3 | 3 | – | – | – | – | – | – | – | – | DENOMINATOR (CONTROL CYCLE) |

FIG. 8G

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 51% | 51 | 6 | 6 | 6 | 6 | 6 | 6 | 5 | 5 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 52% | 13 | 6 | 6 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 53% | 53 | 6 | 6 | 6 | 6 | 6 | 6 | 6 | 6 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 54% | 23 | 6 | 5 | 5 | 5 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 55% | 11 | 7 | 4 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 56% | 14 | 7 | 6 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 57% | 57 | 6 | 6 | 6 | 6 | 6 | 6 | 6 | 6 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 58% | 29 | 7 | 7 | 7 | 6 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |

FIG. 8H

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 59% | 59 | 7 | 7 | 7 | 7 | 7 | 7 | 6 | 6 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 60% | 3 | 3 | – | – | – | – | – | – | – | – | – | NUMERATOR (NUMBER OF HEATER TURN-ON) |
| | 5 | 5 | – | – | – | – | – | – | – | – | – | DENOMINATOR (CONTROL CYCLE) |
| 61% | 61 | 8 | 8 | 8 | 7 | 7 | 7 | 6 | 5 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 62% | 31 | 8 | 8 | 7 | 6 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 63% | 63 | 8 | 8 | 7 | 7 | 7 | 7 | 7 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 64% | 16 | 11 | 4 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 65% | 13 | 11 | 2 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 66% | 33 | 11 | 9 | 7 | 4 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |

FIG. 8I

| HEATER TURN-ON DUTY (FRACTION REPRESENTATION) | | CON-TROL PAT-TERN 1 | CON-TROL PAT-TERN 2 | CON-TROL PAT-TERN 3 | CON-TROL PAT-TERN 4 | CON-TROL PAT-TERN 5 | CON-TROL PAT-TERN 6 | CON-TROL PAT-TERN 7 | CON-TROL PAT-TERN 8 | CON-TROL PAT-TERN 9 | CON-TROL PAT-TERN 10 | |
|---|---|---|---|---|---|---|---|---|---|---|---|---|
| 67% | 67 | 8 | 8 | 8 | 8 | 8 | 8 | 7 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 68% | 17 | 8 | 7 | 2 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 69% | 69 | 9 | 8 | 8 | 8 | 8 | 8 | 8 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 70% | 7 | 6 | 1 | – | – | – | – | – | – | – | – | NUMERATOR (NUMBER OF HEATER TURN-ON) |
| | 10 | 7 | 3 | – | – | – | – | – | – | – | – | DENOMINATOR (CONTROL CYCLE) |
| 71% | 71 | 9 | 9 | 9 | 8 | 8 | 8 | 8 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 72% | 18 | 8 | 8 | 2 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 73% | 73 | 9 | 9 | 9 | 9 | 9 | 8 | 8 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 74% | 37 | 11 | 11 | 9 | 4 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 75% | 6 | 5 | 1 | – | – | – | – | – | – | – | – | NUMERATOR (NUMBER OF HEATER TURN-ON) |
| | 8 | 5 | 3 | – | – | – | – | – | – | – | – | DENOMINATOR (CONTROL CYCLE) |

FIG. 8J

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 76% | 19 | 9 | 8 | 2 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 77% | 77 | 10 | 10 | 10 | 9 | 9 | 9 | 8 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 78% | 39 | 11 | 11 | 11 | 4 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 79% | 79 | 10 | 10 | 10 | 10 | 10 | 9 | 8 | 7 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 80% | 4 | 4 | – | – | – | – | – | – | – | – | – | NUMERATOR (NUMBER OF HEATER TURN-ON) |
| | 5 | 5 | – | – | – | – | – | – | – | – | – | DENOMINATOR (CONTROL CYCLE) |
| 81% | 81 | 11 | 11 | 11 | 11 | 11 | 11 | 11 | 2 | 1 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 82% | 41 | 11 | 11 | 11 | 6 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 83% | 83 | 11 | 11 | 11 | 11 | 11 | 11 | 11 | 4 | 1 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |

FIG. 8K

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 84% | 21 | 11 | 9 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 85% | 17 | 11 | 6 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 86% | 43 | 11 | 11 | 11 | 8 | 1 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 87% | 87 | 11 | 11 | 11 | 11 | 11 | 11 | 11 | 8 | 1 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 88% | 22 | 11 | 10 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 89% | 89 | 11 | 11 | 11 | 11 | 11 | 11 | 11 | 10 | 1 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 90% | 9 | 7 | 2 | – | – | – | – | – | – | – | – | NUMERATOR (NUMBER OF HEATER TURN-ON) |
| | 10 | 7 | 3 | – | – | – | – | – | – | – | – | DENOMINATOR (CONTROL CYCLE) |
| 91% | 91 | 11 | 11 | 11 | 11 | 11 | 11 | 11 | 11 | 2 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |

FIG. 8L

| HEATER TURN-ON DUTY (FRACTION REPRESENTATION) | | CONTROL PATTERN 1 | CONTROL PATTERN 2 | CONTROL PATTERN 3 | CONTROL PATTERN 4 | CONTROL PATTERN 5 | CONTROL PATTERN 6 | CONTROL PATTERN 7 | CONTROL PATTERN 8 | CONTROL PATTERN 9 | CONTROL PATTERN 10 | |
|---|---|---|---|---|---|---|---|---|---|---|---|---|
| 92% | 23 | 11 | 11 | 1 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 93% | 93 | 11 | 11 | 11 | 11 | 11 | 11 | 11 | 11 | 4 | 1 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 94% | 47 | 11 | 11 | 11 | 11 | 2 | 1 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 95% | 19 | 11 | 8 | – | – | – | – | – | – | – | – | NUMERATOR (NUMBER OF HEATER TURN-ON) |
| | 20 | 11 | 9 | – | – | – | – | – | – | – | – | DENOMINATOR (CONTROL CYCLE) |
| 96% | 24 | 11 | 11 | 2 | – | – | – | – | – | – | – | NUMERATOR (NUMBER OF HEATER TURN-ON) |
| | 25 | 11 | 11 | 3 | – | – | – | – | – | – | – | DENOMINATOR (CONTROL CYCLE) |
| 97% | 97 | 11 | 11 | 11 | 11 | 11 | 11 | 11 | 11 | 7 | 2 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |
| 98% | 49 | 11 | 11 | 11 | 11 | 3 | 2 | – | – | – | – | NUMERATOR (NUMBER OF HEATER TURN-ON) |
| | 50 | 11 | 11 | 11 | 11 | 3 | 3 | – | – | – | – | DENOMINATOR (CONTROL CYCLE) |
| 99% | 99 | 11 | 11 | 11 | 11 | 11 | 11 | 11 | 11 | 9 | 2 | NUMERATOR (NUMBER OF HEATER TURN-ON) |
| | 100 | 11 | 11 | 11 | 11 | 11 | 11 | 11 | 11 | 9 | 3 | DENOMINATOR (CONTROL CYCLE) |

FIG. 9

| | NUMERATOR | | | | | | | | | | | |
|---|---|---|---|---|---|---|---|---|---|---|---|---|
| DE-NOM-INA-TOR | 0 | 1 | 2 | 3 | 4 | 5 | 6 | 7 | 8 | 9 | 10 | 11 |
| 1 | 0.00% | 100.00% | – | – | – | – | – | – | – | – | – | – |
| 2 | 0.00% | 50.00% | 100.00% | – | – | – | – | – | – | – | – | – |
| 3 | 0.00% | 33.33% | 66.67% | 100.00% | – | – | – | – | – | – | – | – |
| 4 | 0.00% | 25.00% | 50.00% | 75.00% | 100.00% | – | – | – | – | – | – | – |
| 5 | 0.00% | 20.00% | 40.00% | 60.00% | 80.00% | 100.00% | – | – | – | – | – | – |
| 6 | 0.00% | 16.67% | 33.33% | 50.00% | 66.67% | 83.33% | 100.00% | – | – | – | – | – |
| 7 | 0.00% | 14.29% | 28.57% | 42.86% | 57.14% | 71.43% | 85.71% | 100.00% | – | – | – | – |
| 8 | 0.00% | 12.50% | 25.00% | 37.50% | 50.00% | 62.50% | 75.00% | 87.50% | 100.00% | – | – | – |
| 9 | 0.00% | 11.11% | 22.22% | 33.33% | 44.44% | 55.56% | 66.67% | 77.78% | 88.89% | 100.00% | – | – |
| 10 | 0.00% | 10.00% | 20.00% | 30.00% | 40.00% | 50.00% | 60.00% | 70.00% | 80.00% | 90.00% | 100.00% | – |
| 11 | 0.00% | 9.09% | 18.18% | 27.27% | 36.36% | 45.45% | 54.55% | 63.64% | 72.73% | 81.82% | 90.91% | 100.00% |

FIXING APPARATUS WITH A CONTROL UNIT FOR POWERING A FIXING HEATER USING A COMBINATION OF CONTROL PATTERNS, AND IMAGE-FORMING APPARATUS USING THE SAME

CROSS REFERENCE TO RELATED APPLICATION

The present invention contains subject matter related to Japanese Patent Application JP 2014-056240 filed in the Japanese Patent Office on Mar. 19, 2014, the entire contents of which being incorporated herein by reference.

BACKGROUND OF THE INVENTION

1. Field of the Invention

The present invention relates to a fixing apparatus that fixes an image formed on a sheet by heat and an image-forming apparatus that uses such a fixing apparatus.

2. Description of Related Art

An image-forming apparatus of electrographic type such as a printer and copier has been known in the past. Such an image-forming apparatus has formed an image on a sheet by carrying out a series of transferring the image on the sheet and then fixing the image to the sheet. The image-forming apparatus includes a fixing apparatus that performs a fixing process. The fixing apparatus includes a fixing heater that performs any heat fixing.

It is desirable in the fixing heater that times of on/off in a hysteresis control are limited in order to reduce a temperature ripple in a fixing process. Accordingly, heater turn-on duty (hereinafter, also referred to as "duty") while a heater turns on during each control period of time and by which power to be supplied to the fixing heater is determined has been adjusted until now by any phase control or the like. This causes power to the fixing heater to be controlled so that the fixing heater can reduce any temperature ripple. For example, Japanese Patent Application Publication No. 2000-347530 discloses a technology to adjust power to be supplied to the fixing heater by detecting any variation in commercial alternating current (AC) voltage applied to the fixing heater and adjusting the duty by the phase control. In order to reduce a generation of a flicker, the phase control is also used to prevent an inrush current from flowing when turning on the fixing heater. Further, it is preferable to cope with standards of harmonics, terminal noises other than the flicker.

Here, the flicker is referred to as such a phenomenon that a device, for example, lighting equipment that is connected to an alternating current power supply which is also connected to the image-forming apparatus flickers based on a sudden variation in the voltage generated for every time of the turn-on/off of the fixing heater. Additionally, in order to reduce the temperature ripple, switching frequency of the turn-on/off of the fixing heater increases so that the flicker has remarkable influence on the lighting equipment or the like.

When reducing power consumption of the image-forming apparatus, heat capacity of the fixing apparatus has often reduced because the power reduction of the fixing apparatus has large influence thereon. However, when reducing the heat capacity of the fixing apparatus, the temperature ripple in the fixing apparatus is remarkable so that this temperature ripple may have large influence on the fixing performance of the fixing apparatus.

It is effective to perform any power control in order to reduce the temperature ripple in the fixing apparatus. As such a power control, a control to adjust the duty by the phase control or a pulse width modulation (PWM) control has been used. It, however, is desirable that the image-forming apparatus also satisfies various kinds of standards such as disturbance voltage, harmonic distortion regulation, flicker regulation and the like. Accordingly, as one of the power controls that are effective to these standards, half cycle duty (HCD) control in which the fixing heater selectively turns on or off based on a half of the alternative current cycle as one unit has been proposed.

SUMMARY OF THE INVENTION

In the HCD control, a control pattern in which integral multiplication of the half cycle is set as one control period of time and a period of time when the fixing heater turns on and a period of time when the fixing heater turns off are set. On the other hand, in the HCD control, there is also a control pattern which does not satisfy a standard for preventing the flicker.

To obtain a desired fixing temperature, it is desirable to supply any power according thereto to the fixing heater. On the other hand, when using only a control pattern which satisfies the standard for preventing the flicker, the power to be supplied to the fixing heater may be limited. When different AC voltage values are applied across the fixing heater, the power differs from each other even if their duties are the same. This fails to obtain a desired power.

Further, when using the heaters having the same specification and different AC voltage values are applied across the fixing heaters, their power differs from each other even if their duties are the same. To obtain the same power, it is desirable that the fixing heaters having any different specifications based on the AC voltage values are used.

The present invention addresses the above-described issues by using control patterns that satisfy a standard for preventing the flicker or the like in the HCD control. The present invention provides a fixing apparatus to which a desired power is supplied regardless of any voltage value applied to the fixing heater, and an image-forming system that uses such a fixing apparatus.

To address the above mentioned issues, a fixing apparatus reflecting one aspect of the present invention contains a fixing heater that performs heat fixing, a control unit that controls the fixing heater based on control patterns in each of which turn-on period of the fixing heater and turn-off period of the fixing heater are set according to a control cycle with a half cycle of alternate current supplied from alternate current power supply being as one unit, a temperature-detecting unit that detects temperature of the fixing heater and a voltage-value-acquiring unit that acquires a voltage value that is applied to the fixing heater, wherein the control unit is configured so as to turn the fixing heater on or off using a combination of the control patterns each satisfying a predetermined standard during each control period of time that is integral multiplication of the control cycle according to the temperature of the fixing heater detected by the temperature-detecting unit and the voltage value, which is allied to the fixing heater, acquired by the voltage-value-acquiring unit.

According to embodiments of the present invention, it is desired to provide the fixing apparatus wherein, by an algorithm in which heater turn-on duty by which power to be supplied to the fixing heater during each control period of time is determined is represented as a fraction, a denominator of the fraction representing the heater turn-on duty is represented using sum of designated odd numbers so that number of term thereof is fewest, and a numerator is selected so that maximum number of the heater turn-on duty becomes smallest among combinations of the denominator and the numerator which satisfy the predetermined standard, the combination of the control patterns corresponding to the heater turn-on duty, in which the denominator represents numbers of the control cycles and the numerator represents numbers of turn-on of the fixing heater, is formed.

It is further desired to provide the fixing apparatus wherein the combination of the control patterns corresponding to the heater turn-on duty is selected by referring to a table which stores the combination of the control patterns in each of which the denominator represents number of the control cycle and the numerator represents number of turn-on of the fixing heater, the control patterns being produced by an algorithm in which heater turn-on duty by which power to be supplied to the fixing heater during each control period of time is determined is represented as a fraction, a denominator of the fraction representing the heater turn-on duty is represented using sum of designated odd numbers so that number of term is fewest, and a numerator is selected so that maximum number of the heater turn-on duty becomes smallest among combinations of the denominator and the numerator which satisfy the predetermined standard.

It is additionally desired to provide the fixing apparatus wherein the fixing heater repeats to changeably turns on or off one or more times in the control period of time according to the control patterns in order that the heater turn-on duty is smaller among the combination of the control patterns corresponding to the heater turn-on duty to be used.

It is still further desired to provide the fixing apparatus wherein the voltage-value-acquiring unit includes a voltage detection portion that detects voltage applied to the fixing heater, and the heater turn-on duty by which power to be supplied to the fixing heater is determined is changed on the basis of the voltage detected by the voltage detection portion.

It is still additionally desired to provide the fixing apparatus wherein the voltage-value-acquiring unit includes a voltage-setting portion that sets voltage applied to the fixing heater, and the heater turn-on duty by which power to be supplied to the fixing heater is determined is changed on the basis of the voltage set by the voltage-setting portion.

Other objects and attainments of the present invention will be become apparent to those skilled in the art upon a reading of the following detailed description when taken in conjunction with the drawing.

BRIEF DESCRIPTION OF THE DRAWINGS

FIG. 5 is a table showing ideal values of the heater turn-on duties corresponding to power to be supplied to the fixing heater;

FIG. 6 is a table showing values of the heater turn-on duties corresponding to the power to be supplied to the fixing heater, in a related control;

FIG. 7 is a table showing values of the heater turn-on duties corresponding to the power to be supplied to the fixing heater, selected in a control of the embodiment of this invention;

FIG. 8A is a table showing an example (Part one) of a combination of the heater turn-on duty and control patterns;

FIG. 8B is a table showing an example (Part two) of the combination of the heater turn-on duty and control patterns;

FIG. 8C is a table showing an example (Part three) of the combination of the heater turn-on duty and control patterns;

FIG. 8D is a table showing an example (Part four) of the combination of the heater turn-on duty and control patterns;

FIG. 8E is a table showing an example (Part five) of the combination of the heater turn-on duty and control patterns;

FIG. 8F is a table showing an example (Part six) of the combination of the heater turn-on duty and control patterns;

FIG. 8G is a table showing an example (Part seven) of the combination of the heater turn-on duty and control patterns;

FIG. 8H is a table showing an example (Part eight) of the combination of the heater turn-on duty and control patterns;

FIG. 8I is a table showing an example (Part nine) of the combination of the heater turn-on duty and control patterns;

FIG. 8J is a table showing an example (Part ten) of the combination of the heater turn-on duty and control patterns;

FIG. 8K is a table showing an example (Part eleven) of the combination of the heater turn-on duty and control patterns;

FIG. 8L is a table showing an example (Part twelve) of the combination of the heater turn-on duty and control patterns;

FIG. 9 is a table showing examples of control patterns which satisfy a standard for preventing a flicker.

DESCRIPTION OF THE PREFERRED EMBODIMENTS

The following will describe embodiments of a fixing apparatus and an image-forming system using the same according to the present invention with reference to the drawings. Such description does not limit the technical scope, meaning of terms and the like in Claims.

Figure 1:
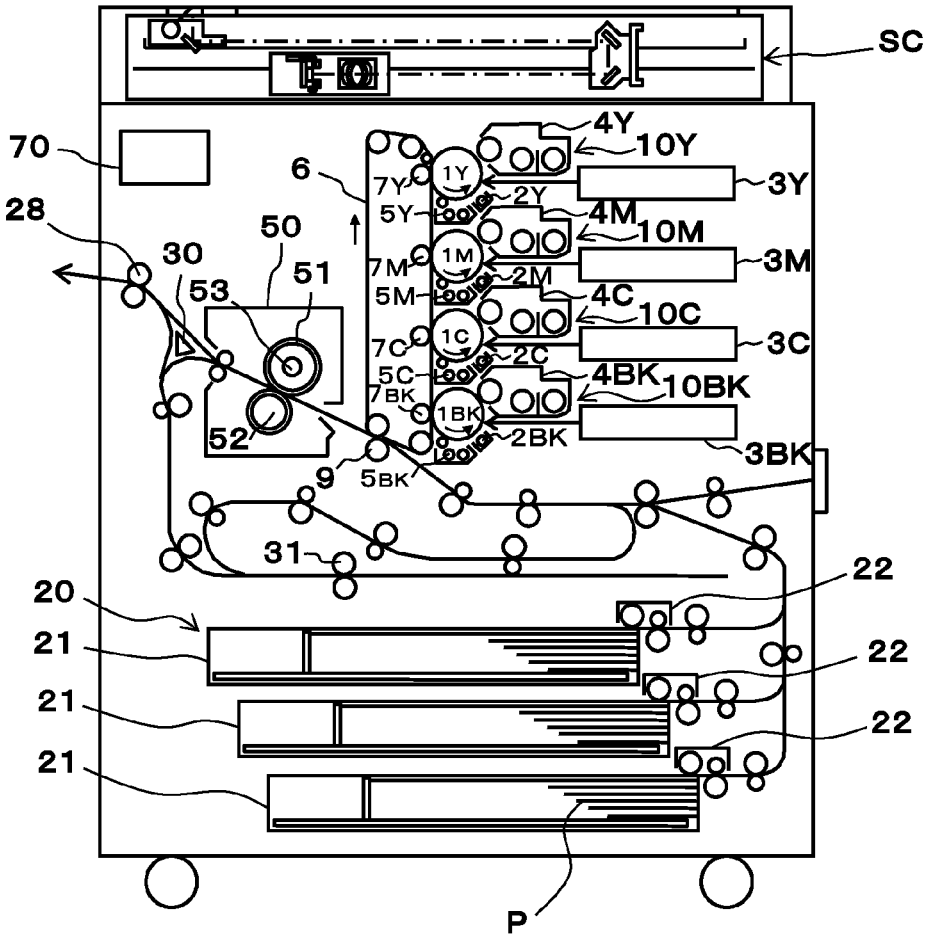
FIG. 1 is a diagram schematically showing a configuration example of an image-forming apparatus according to an embodiment of the invention.

FIG. 1 schematically shows a configuration example of an image-forming apparatus 1 according to an embodiment of the invention. The image-forming apparatus 1 is an image forming apparatus of electrographic type such as a copier. This image forming apparatus 1 is also a color image forming apparatus of so-called tandem type in which plural photoreceptors are vertically arranged with them being opposed to an intermediate transfer belt to form a full color image.

The image forming apparatus 1 includes a document reading apparatus SC, image forming units 10Y, 10M, 10C and 10K, a fixing apparatus 50 and a controller 70.

The document reading apparatus SC scans an image on the document to expose it using an optical system of a scanning and exposure device and receives its reflected light by a line image sensor to read the image, thereby forming an image signal. The image processing portion, not shown, then performs a predetermined processing such as an analog-to-digital (A/D) conversion processing, a shade correction, image compression processing and the like on this image signal and outputs it to the controller 70. The controller 70 receives this image signal as image data. The image data received by the controller 70 may include the image data received from a personal computer or another image forming apparatus which is connected to the image forming apparatus, the image data stored in portable recording media such as USB memory other than the image data read by the document reading apparatus SC.

The image forming unit 10Y forms a yellow (Y) image. The image forming unit 10M forms a magenta (M) image. The image forming unit 10C forms a cyan (C) image. The image forming unit 10K forms a black (K) image. In this embodiment, in order to indicate a color relative to common function or name, Y, M, C or K will be attached to the number of the common function or name, for example, 10Y, 10M, 10C and 10K.

The image forming unit 10Y includes a photosensitive drum 1Y, a charging portion 2Y arranged around the photosensitive drum 1Y, an optical writing portion 3Y, a developing portion 4Y and a drum cleaner 5Y. The image forming unit 10M includes a photosensitive drum 1M, a charging portion 2M arranged around the photosensitive drum 1M, an optical writing portion 3M, a developing portion 4M and a drum cleaner 5M. The image forming unit 10C includes a photosensitive drum 1C, a charging portion 2C arranged around the photosensitive drum 1C, an optical writing portion 3C, a developing portion 4C and a drum cleaner 5C. The image forming unit 10K includes a photosensitive drum 1K, a charging portion 2K arranged around the photosensitive drum 1K, an optical writing portion 3K, a developing portion 4K and a drum cleaner 5K.

Each of the charging portions 2Y, 2M, 2C and 2K uniformly charges static charges around a surface of each of the photosensitive drums 1Y, 1M, 1C and 1K. Each of the optical writing portions 3Y, 3M, 3C and 3K scans each of the photosensitive drums 1Y, 1M, 1C and 1K by laser light to form an electrostatic latent image on each of the photosensitive drums 1Y, 1M, 1C and 1K. Each of the developing portions 4Y, 4M, 4*c* and 4K develops the electrostatic latent image formed on each of the photosensitive drums 1Y, 1M, 1C and 1K using toners. Thus, an image (toner image) having a predetermined color, which corresponds to any of colors, yellow, magenta, cyan and black, is formed on each of the photosensitive drums 1Y, 1M, 1C and 1K. Primary transfer rollers 7Y, 7M, 7C and 7K transfer the images formed on the photosensitive drums 1Y, 1M, 1C and 1K to their predetermined positions on an intermediate transfer belt 6, which is a belt type intermediate transfer member, one by one.

The secondary transfer rollers 9 transfers the respective color images transferred on the intermediate transfer belt 6 to a sheet P conveyed from a sheet feeder 20, which will be described later, at a predetermined timing. The secondary transfer rollers 9 are arranged with them being contacted to each other with pressure to form a nip portion (transfer nip portion) therebetween so that they can transfer the images onto the sheet P while the sheet P is conveyed.

The sheet feeder 20 feeds the sheets P on a conveying path. The sheet feeder 20 has plural feeding trays 21 each containing sheets P. Feeding portions 22 feed the sheets P one by one from the selected feeding tray and conveys the fed sheet P to the conveying path. On an upstream side from the nip portion in the conveying path, plural conveying means for conveying the sheets P are arranged. Each conveying means is composed of a pair of rollers which are contacted to each other with pressure. At least one roller rotates by an electric motor as driving means. The rollers rotate while the sheet P is nipped to convey the sheet P. It is to be noted that the conveying means may adopt a pair of rotation members such as a combination of belts, a combination of the belt and roller other than a pair of rollers. The fixing apparatus 50 fixes the toner images, which have been transferred on the surface of the sheet P, to the sheet P by applying pressure to the sheet P and heating the same. The fixing apparatus 50 includes a pair of fixing members that are contacted to each other with pressure to form a nip (fixing nip portion) between them and heating means for heating the fixing members. For example, the pair of fixing members is fixing rollers 51 and 52. Respective fixing rollers are configured so to be rotatable. At least one roller, for example, the fixing roller 52, rotates by a driving motor, not shown, as the driving means. The heating means is, for example, a fixing heater 53. For example, a halogen lamp is used as the fixing heater 53 which turns on by current flow. The fixing apparatus 50 conveys the sheet P and fixes the image to the sheet P by applying pressure to the sheet P by means of the pair of fixing rollers 51 and 52 and heating it by means of the fixing heater 53.

Ejection rollers 28 eject onto a sheet-ejection tray, not shown, the sheet P which the fixing apparatus 50 has fixed. Additionally, when forming an image on a rear surface of the sheet P, a change-over gate 31 conveys the sheet P, the surface of which has been already printed, to lower reverse rollers 31. These reverse rollers 31 nip a rear end of the conveyed sheet P and then send the sheet P to a reverse direction to reverse it and to dispatch the sheet P to a sheet-re-feeding path. Plural conveying means for re-feeding the sheet P convey the sheet P dispatched to this sheet-re-feeding path to the transfer position thereof.

The controller 70 has a function to integrally control the image forming apparatus. The controller 70 uses, for example, a microcomputer which includes a central processing unit (CPU), a read only memory (ROM), a random access memory (RAM) and input/output (I/O) interface. The controller 70 controls the image forming units 10Y, 10M, 10C and 10K, the fixing apparatus 50 and the like to form the image on the sheet P.

Figure 2:
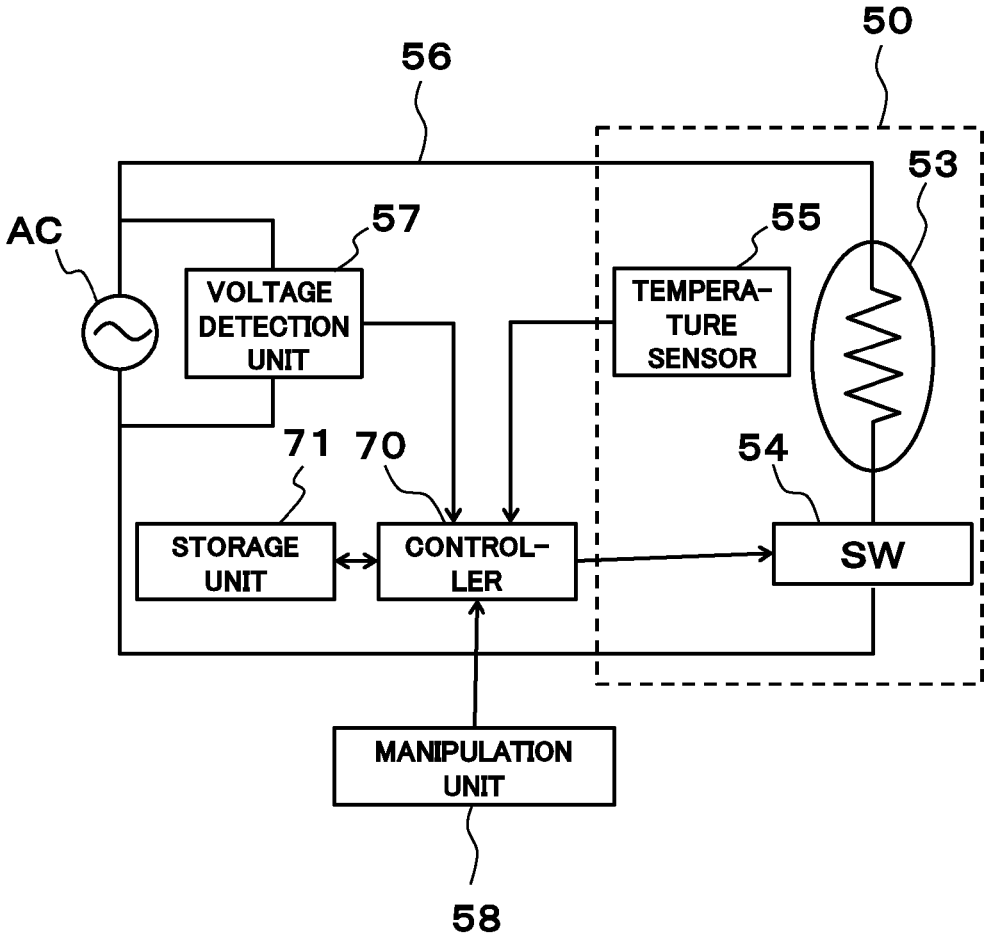
FIG. 2 is a block diagram showing a configuration example of a fixing apparatus according to an embodiment of the invention.

FIG. 2 shows a configuration example of the fixing apparatus 50. The controller 70 also has a function to control the fixing apparatus 50 in this embodiment. Specifically, the controller 70 performs a control of the fixing heater 53 to turn on or off based on a previously set target fixing temperature and detected or set voltage of power supply.

An alternating current power supply AC is used under use environment of the image forming apparatus 1 such as an office. The alternating current power supply AC is connected to the fixing heater 53 via a power line 56. A switching unit 54 that switches from an off-state in which the fixing heater 53 turn off by disconnecting the power line 56 from the fixing heater 53 to an on-state in which the fixing heater 53 turn on by connecting the power line 56 to the fixing heater 53 and vice versa is arranged between the fixing heater 53 and the alternating current power supply AC. The controller 70 controls the switching unit 54 to switch from the off-state to the on-state and vice versa.

The switching unit 54 is composed of triac (bidirectional thyristor) and the like. This invention, however, is not limited thereto: The switching unit 54 may be composed of a transistor, a switching element such as insulated gate bipolar transistor (IGBT) and the like when it is possible to realize any switch control as a unit of a half cycle of the alternating current power supply AC based on zero cross.

The controller 70 receives a detection signal indicating any temperature information from a temperature sensor 55 that detects temperature of the fixing heater 53. The controller 70 also receives a detection signal indicating any voltage information from a voltage detection unit 57 that detects voltage of the alternating current power supply AC. The controller 70 determines which the fixing heater 53 turns on or off based on the temperature of the fixing heater 53 detected by the temperature sensor 55 and the voltage of the alternating current power supply AC detected by the voltage detection unit 57 so that the power to be supplied to the fixing heater 53 becomes desired power based on the desired hater turn-on duty.

Specifically, the controller 70 calculates a temperature difference between a target temperature and the temperature detected by the temperature sensor 55. The controller 70 determines which the fixing heater 53 turns on or off based on the temperature difference. The controller 70 also determines which the fixing heater 53 turns on or off based on the voltage detected by the voltage detection unit 57.

When the fixing heater 53 turn on, the controller 70 controls the switching unit 54 to switch from the on-state to the off-state and vice versa so that the power to be supplied to the fixing heater 53 becomes any desired power based on the desired hater turn-on duty according to the temperature difference between the target temperature and the temperature detected by the temperature sensor 55 and the voltage of the alternating current power supply AC detected by the voltage detection unit 57. Further, a manipulation unit 58 in the image forming apparatus may be used as a voltage setting unit. The manipulation unit 58 can manually input voltage values of the alternating current power supply AC. The controller 70 controls a storage unit 71 to store the input voltage values. The controller 70 then controls the switching unit 54 to switch from the on-state to the off-state and vice versa so that the power to be supplied to the fixing heater 53 becomes any desired power based on desired hater turn-on duty according to the manually input voltage value. The controller 70 performs such a switching control based on a half cycle of the alternating current power supply AC as one unit. When the alternating current power supply AC has a frequency of 50 Hz, its half cycle is 10 msec. The controller 70 outputs an on-signal or an off-signal to the switching unit 54 for every 10 msec. When using the triac as the switching unit 54 as described above, the switching unit 54 becomes the on state if the switching unit 54 receives the on-signal from the controller 70 at a timing of the zero cross of the alternating current power supply AC. On the other hand, the switching unit 54 becomes the off state if the switching unit 54 receives the off-signal from the controller 70 at that timing.

The storage unit 71 stores control patterns for controlling the fixing heater to turn on or off. The controller 70 controls the switching unit 54 to perform such a switching control by outputting the on-signal or the off-signal for switching the fixing heater 53 from turn-on to turn-off and vice versa to the switching unit 54 based on these control patterns.

In the HCD control in which the fixing heater 53 selectively turns on or off based on a control cycle in which a half cycle of the alternating current power supply AC is set as a unit cycle, a period of time when the fixing heater turns on while the switching unit 54 is the on-state or a period of time when the fixing heater turns off while the switching unit 54 is the off-state is set for every control cycle. The control patterns are set so that one control period of time is an integral multiplication of the control cycle and a period of time when the controller 70 outputs the on-signal and a period of time when the controller 70 outputs the off-signal meet a span of the control cycle(s).

The span of one control period of time represents number of the control cycles and by number of signal output within one control period of time, namely, number of turn-on of the fixing heater 53, the desired heater turn-on duty by which the power to be supplied to the fixing heater 53 is determined, is fixed. The storage unit 71 stores plural control patterns according to the heater turn-on duties.

Figures 3, 4:
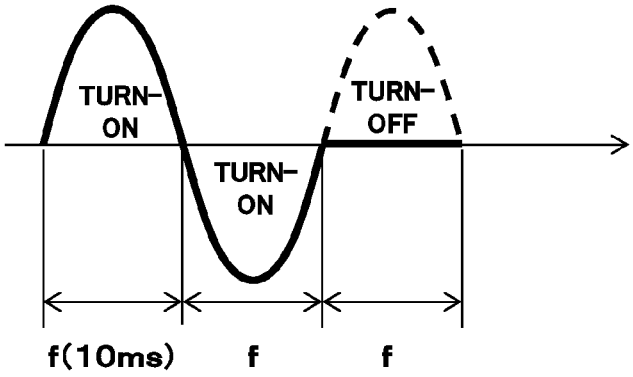
FIG. 3 is a graph showing a voltage wave form according to a control pattern.
FIG. 4 is a table showing a relationship between examples of the control patterns and heater turn-on duties.

The following will describe the control patterns more in detail. FIG. 3 shows a voltage wave form according to a control pattern. In FIG. 3, a solid line indicates the heater turn-on period of time and the dotted line indicates the heater turn-off period of time. When the alternating current power supply AC has a frequency of 50 Hz, its control cycle f is 10 msec. When the alternating current power supply AC has a frequency of 60 Hz, its control cycle f is 8.33 .msec.

In a case shown in FIG. 3, a control pattern is shown in which the numbers of the control cycles are three and the numbers of turn-on of the fixing heater 53 are two. In this case, the fixing heater 53 turns on during a two third of the control period of time, three control cycles and the fixing heater 53 turns off during a one third of the control period of time. Thus, the heater turn-on duty is ⅔, namely, 66.66.%.

FIG. 4 shows a relationship between examples of the control patterns and heater turn-on duties corresponding thereto. In HCD control, there is (are) any control patter(s) to be excluded according to a standard for preventing flicker and/or high frequency noise. For example, in the control patterns shown in FIG. 4, the control pattern in which control cycles are two and the number of turn-on of the fixing heater 53 is one represents the heater turn-on duty of 50%. This control patter, however, does not satisfy any standard for preventing flicker and the like.

On the other hand, when a desired heater turn-on duty is not obtained among the control patterns satisfying the above standard, a control pattern that closely relates to the heater turn-on duty by which the power to be supplied to the fixing heater is determined has been selected in the past among the control patterns corresponding to the above standard.

FIGS. 5 through 7 show values of the heater turn-on duties corresponding to the power to be supplied to the fixing heater. FIG. 5 shows ideal values of the heater turn-on duties corresponding to power to be supplied to the fixing heater for every voltage applied to the fixing heater. FIG. 6 shows control patterns P10 selected by the related control corresponding to the power to be supplied to the fixing heater and the heater turn-on duty D10 of each control pattern P10 for every voltage applied to the fixing heater. FIG. 7 shows control patterns P1 selected by the control according to the embodiment of this invention corresponding to the power to be supplied to the fixing heater and the heater turn-on duty D1 of each control pattern P1 for every voltage applied to the fixing heater.

Each of the control patterns P10 shown in FIG. 6 satisfies the above-mentioned standard and represents as a fraction a combination of the number of control cycles P10*a* and the number of turn-on P10*b* of the fixing heater, the combination, namely, the heater turn-on duty representing the power to be supplied to the fixing heater. The heater turn-on duty D10 is represented by unit of %.

Each of the control patterns P1 shown in FIG. 7 represents as a fraction a combination of the number of control cycles P1*a* and the number of turn-on P1*b* of the fixing heater based on a combination of the control patterns each satisfying the above-mentioned standard. The heater turn-on duty D1 is represented by unit of %.

As shown in FIG. 5, when the power to be supplied to the fixing heater is 100 W, the ideal value of the heater turn-on duty is 10% if the voltage allied to the fixing heater is 160 V. On the other hand, on the control pattern P10 selected in the related control, as shown in FIG. 6, when the power to be supplied to the fixing heater is 100 W, the value of the heater turn-on duty D10 is 9.09% if the voltage allied to the fixing heater is 160 V.

Further, as shown in FIG. 5, when the power to be supplied to the fixing heater is 100 W, the ideal value of the heater turn-on duty is 4.44% if the voltage allied to the fixing heater is 240 V. However, on the control pattern P10 selected in the related control, as shown in FIG. 6, when the power to be supplied to the fixing heater is 100 W, the value of the heater turn-on duty D10 is 9.09% if the voltage allied to the fixing heater is 240 V. The value, 9.09% of the heater turn-on duty D10 is different from the ideal value, 4.44% of the heater turn-on duty by 4% or more.

Thus, in the related control, there may be a case where the heater turn-on duty that is very different from the ideal value of the duty by which the power to be supplied to the fixing heater is determined is selected. Accordingly, the heater turn-on duty is very different from the ideal value thereof based on the heater allied voltage and the power to be supplied to the fixing heater so that accuracy of the heater turn-on duty is not good.

Accordingly, in this embodiment, by combining plural control patterns each corresponding to the standard, the control pattern that closely relates to the heater turn-on duty by which the power to be supplied to the fixing heater is determined is selected. For example, in a case shown in FIG. 4, the control pattern in which the numbers of the control cycles are three and the number of turn-on of the fixing heater is one and the control pattern in which the numbers of the control cycles are three and the numbers of turn-on of the fixing heater are two are selected among the control patterns corresponding to the above-mentioned standard and they are combined. Therefore, the control pattern in which the numbers of the control cycles are six (3+3=6) and the numbers of turn-on of the fixing heater are three (1+2=3) is obtained so that the heater turn-on duty thereof becomes 50% and it also satisfies the standard.

Taking into consideration any difference between voltages of the alternating current power supply, as shown in FIG. 7, when the power to be supplied to the fixing heater is 100 W, the value of the heater turn-on duty D1 in the control pattern P1 selected by the control according to the embodiment of this invention is 10% if the voltage allied to the fixing heater is 160 V; when the power to be supplied to the fixing heater is 100 W, the value of the heater turn-on duty D1 in the control pattern P1 selected by the control according to the embodiment of this invention is 4.00% if the voltage allied to the fixing heater is 240 V.

Thus, by the control according to the embodiment of this invention, it is possible to select the heater turn-on duty that corresponds to the above-mentioned standard and is almost same as the ideal value of the heater turn-on duty, by which the power to be supplied to the fixing heater is determined. The accuracy of the heater turn-on duty is almost constant regardless the power to be supplied to the fixing heater and the heater applied voltage and the heater turn-on duty is different from the ideal value thereof by 0.5% or less.

The following will describe an algorithm that produces the control patterns according to the embodiment of the invention. FIGS. 8A through 8L show an example of a combination of the heater turn-on duties and the control patterns for every heater turn-on duty set by the algorithm, which will be described later.

Here, one control period of time is set so as to be "A" sec. In this embodiment, one control period of time is set so as to be one sec. When the alternating current power supply AC has a frequency of 50 Hz, one control period of time is represented by integral. When the alternating current power supply AC has a frequency of 60 Hz, one control period of time is represented by 6/5 multiplied by integral. An extent of the heater turn-on duty demonstrates 1 through 99%. Its resolution is 1%. When the heater turn-on duty is 0%, the fixing heater turns off during whole control period of time without using the following algorithm. When the heater turn-on duty is 100%, the fixing heater turns on during whole control period of time without using the following algorithm. When the heater turn-on duty is 0 or 100%, one control period of time is set so as to be "A" sec and, in this embodiment, one control period of time is set so as to be one sec. It is to be noted that a case where one control period of time is set so as to be one sec will be illustratively described in this embodiment. Since a suitable cycle when temperature in the fixing nip portion is kept constant varies based on heat capacity of the fixing apparatus, heating value of the fixing heater and the like, this invention is not limited thereto.

<Algorithm According to the Embodiment>

(1) The heater turn-on duty by which the power to be supplied to the fixing heater during each control period of time is determined is represented as a fraction.

As the fraction representation of the heater turn-on duty, it is desirable that the denominator thereof is 100 and the numerator thereof is the heater turn-on duty. If reducible, an irreducible fraction may be used. For example, when the heater turn-on duty to be used is 1%, the fraction is $1/100$. When the heater turn-on duty to be used is 2%, the fraction is $2/100=1/50$. When the heater turn-on duty to be used is 4%, the fraction is $4/100=1/25$. When the heater turn-on duty to be used is 5%, the fraction is $5/100=1/20$. When the heater turn-on duty to be used is 10%, the fraction is $10/100=1/10$. When the heater turn-on duty to be used is 20%, the fraction is $20/100=1/5$. When the heater turn-on duty to be used is 25%, the fraction is $25/100=1/4$. When the heater turn-on duty to be used is 50%, the fraction is $50/100=1/2$.

(2) The denominator of the fraction representing the heater turn-on duty to be used is represented using sum of designated odd numbers so that numbers of terms are fewest.

In this embodiment, the denominator of the fraction is represented using sum of odd numbers not exceeding 11 so that numbers of terms thereof are fewest. For example, when the denominator of the fraction is 100, the integral 100 can be represented so as to be split into some terms like 100=11*8+9+3. When the denominator of the fraction is 50, the integral 50 can be represented so as to be split into some terms like 50=11*4+3+3. When the denominator of the fraction is 25, the integral 25 can be represented so as to be split into some terms like 25=11*2+3. When the denominator of the fraction is 20, the integral 20 can be represented so as to be split into some terms like 20=11+9. When the denominator of the fraction is 10, the integral 10 can be represented so as to be split into some terms like 10=7+3. When the denominator of the fraction is 5, the integral 5 is 5 as they are (5=5).

Here, when the denominator of the fraction representing the heater turn-on duty to be used is 4 or 2, the denominator cannot be represented using sum of any odd numbers. In these cases, when the denominator of the fraction is 4, the integral 4 is replaced by 8 and when the denominator of the fraction is 2, the integral 2 is replaced by 6. Then, the above-mentioned items (1) and (2) of the algorithm are performed on them again. For example, when the heater turn-on duty to be used is 25%, the fraction is $25/100=1/4=2/8$. When the heater turn-on duty to be used is 50%, the fraction is $50/100=1/2=3/6$. In these cases, when the denominator of the fraction is 8, the integral 8 can be represented so as to be split into some terms like 8=5+3. When the denominator of the fraction is 6, the integral 6 can be represented so as to be split into some terms like 6=3+3.

(3) The odd number obtained by the above-mentioned item (2) is set as the denominator of each of the control patterns; and the denominator of each of the control patterns indicates number of the control cycles.

When the heater turn-on duty to be used during the one control period of time is 1 or 3% or the like, the denominators of the fractions of the respective control patterns are represented as "11", "11", "11", "11", "11", "11", "11", "11", "9" and "3" if the denominator of the fraction represented as the heater turn-on duty is 100. When the heater turn-on duty to be used during the one control period of time is 2 or 6% or the like, the denominators of the fractions of the respective control patterns are represented as "11", "11", "11", "11", "3" and "3" if the denominator of fraction represented as the heater turn-on duty is 50.

When the heater turn-on duty to be used during the one control period of time is 4 or 8% or the like, the denominators of the fractions of the respective control patterns are represented as "11", "11" and "3" if the denominator of fraction represented as the heater turn-on duty is 25. When the heater turn-on duty to be used during the one control period of time is 5 or 15% or the like, the denominators of the fractions of the respective control patterns are represented as "11" and "9" if the denominator of fraction represented as the heater turn-on duty is 20. When the heater turn-on duty to be used during the one control period of time is 10 or 30% or the like, the denominators of the fractions of the respective control patterns are represented as "7" and "3" if the denominator of fraction represented as the heater turn-on duty is 10. When the heater turn-on duty to be used during the one control period of time is 20 or 40% or the like, the denominator of the fraction of the control pattern is represented as "5" if the denominator of fraction represented as the heater turn-on duty is 5.

When the heater turn-on duty to be used during the one control period of time is 25% or the like, the denominators of the fractions of the respective control patterns are represented as "5" and "3" if the denominator of fraction represented as the heater turn-on duty is 8. When the heater turn-on duty to be used during the one control period of time is 50% or the like, the denominators of the fractions of the respective control patterns are represented as "3" and "3" if the denominator of fraction represented as the heater turn-on duty is 6.

(4) Numerators of the control patterns are selected; and the numerator of each of the control patterns is number of turn-on of the fixing heater.

FIG. 9 shows examples of the control patterns which satisfy a standard for preventing the flicker. In the table shown in FIG. 9, combinations in which short time flicker value Pst is not more than 0.9 are unavailable and are excluded. When the denominator of the fraction in the control pattern is 9, the combinations of the numerators 5 and 8 therewith do not satisfy the standard for preventing the flicker so that they are excluded. Further, when the denominator of the fraction in the control pattern is even number, the combinations of the denominator of even number and the numerators are unavailable because current intensively flows on one way by repeating the same current-flow pattern so that they are excluded.

First, combinations of the denominator and the numerator satisfying the standard for preventing a flicker are selected with reference to FIG. 9. For example, when the denominator of the fraction in the control pattern is 11, the numerator can be selected among 0 through 11. When the denominator of the fraction in the control pattern is 9, the numerator can be selected among 1, 2, 3, 4, 6, 7 and 9. When the denominator of the fraction in the control pattern is 7, the numerator can be selected among 0 through 7. When the denominator of the fraction in the control pattern is 5, the numerator can be selected among 0 through 5. When the denominator of the fraction in the control pattern is 3, the numerator can be selected among 0 through 3. When the denominator of the fraction in the control pattern is 1, the numerator can be selected among 0 through 1.

Next, among the selectable values as the numerators, the numerator of the fraction of each of the control patterns is selected so that maximum number of the heater turn-on duty in the sum of selectable values within the control patterns that include combinations of the denominator and the numerator which satisfy the above-mentioned standard becomes smallest. This prevents any inrush current based on sudden increase of the heater turn-on duty.

For example, when the heater turn-on duty to be used during the one control period of time is 3%, the control patterns have a combination of ten denominators,"11", "11", "11", "11", "11", "11", "11", "11", "9" and "3" of the fraction thereof. The three numerators are selected among the ten numerators corresponding to the denominators, "11" in the control patterns which satisfy the above-mentioned standard so that the maximum number of the heater turn-on duty in the sum of values selected as the numerators within the control patterns. The selected three numerators of the fractions of the control patterns are set so as to be 1 and the other numerators of the fraction of the control patterns are set so as to be 0. In this embodiment, numerators of the fraction of the control patterns 1 through 3 are set so as to be 1 and numerators of the fraction of the control patterns 4 through 10 are set so as to be 0.

All of the combinations of the control patterns shown in FIGS. 8A through 8L, which are produced by the above-mentioned algorithm, satisfy the standard for preventing the flicker. Each control pattern corresponding to the heater turn-on duty of 1 through 99% with resolution of 1% satisfies the standard for preventing the flicker.

The controller 70 shown in FIG. 2 produces the control patterns shown in FIGS. 8A through 8L by carrying out the above-mentioned algorithm and controls the fixing heater 53 based on the control patterns. Alternatively, the storage unit 71 stores a table including the control patterns shown in FIGS. 8A through 8L, which are produced by the above-mentioned algorithm, and the controller 70 controls the fixing heater 53 with reference to this table.

Figure 10:
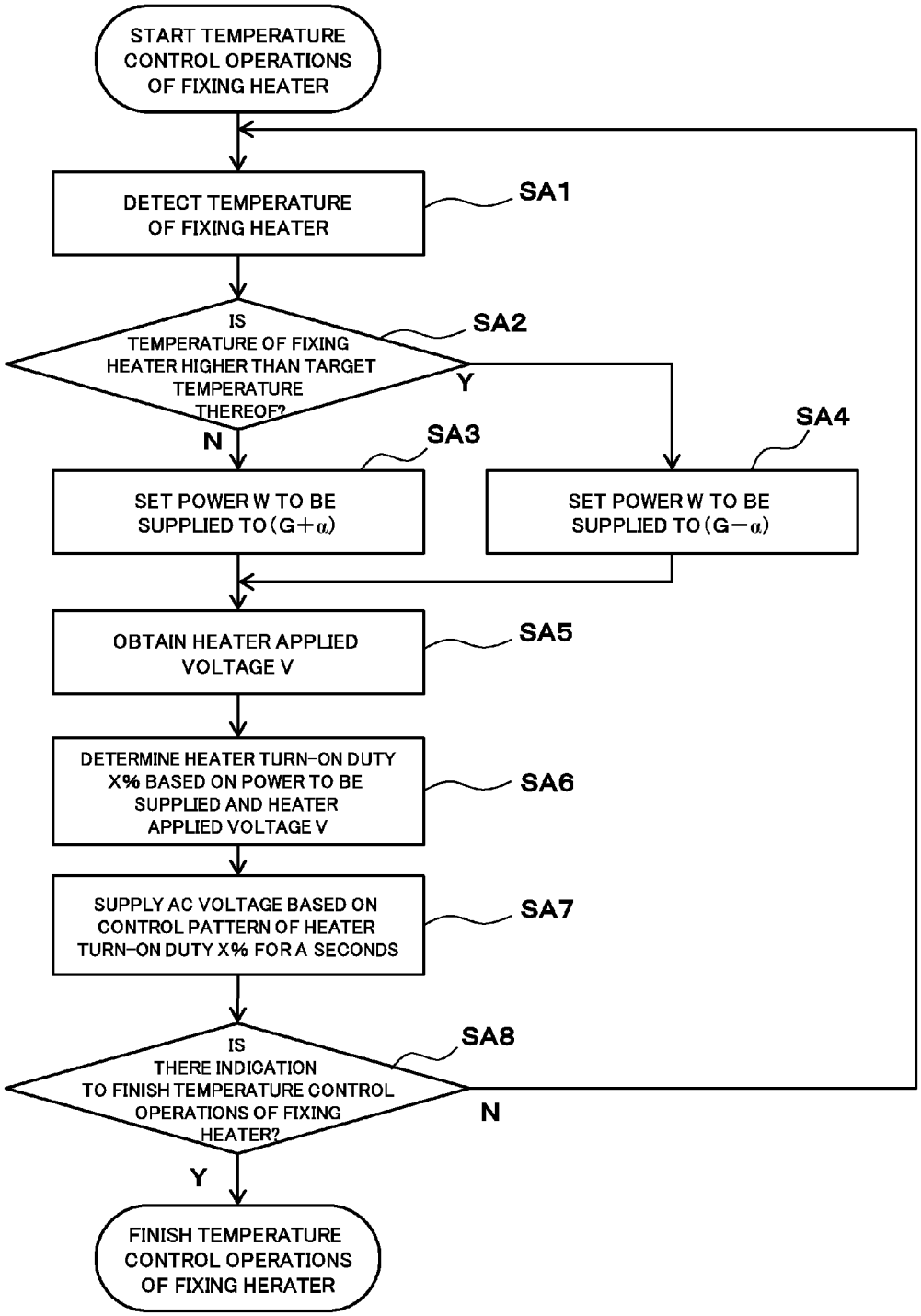
FIG. 10 is a flowchart showing an example of controlling the fixing heater.

FIG. 10 shows an example of controlling the fixing heater 53. The following will describe temperature control operations of the fixing heater 53 according to the embodiment of the invention with reference to the drawings.

At a step SA1 shown in FIG. 10, the controller 70 controls the temperature sensor 55 to detect temperature of the fixing heater 53. At a step SA2 shown in FIG. 10, the controller 70 determines whether or not the detected temperature of the fixing heater 53 is higher than the target temperature thereof.

When the controller 70 determines that the detected temperature of the fixing heater 53 is not higher than the target temperature thereof, at a step SA3 shown in FIG. 10, the controller 70 controls the fixing heater 53 to increase the power W to be supplied. The controller 70 sets a value ($\alpha$) to be added to the supplied power W based on the difference between the temperature of the fixing heater detected by the temperature sensor 53 and the target temperature. The controller 70 sets the new power W to be supplied to the fixing heater 53 so as to be (G+$\alpha$) W when the detected temperature of the fixing heater 53 is not higher than the target temperature thereof and the supplied power W is G. The supplied power W and the value ($\alpha$) to be added to the supplied power W are set so as to be predetermined values corresponding to the heat capacity of the fixing heater 53 and operation modes of the image forming apparatus. For example, the supplied power W is set so as to be 500 W (G=500) and the value ($\alpha$) to be added to the supplied power W are set so as to be 100 W (G=100).

When the controller 70 determines that the detected temperature of the fixing heater 53 is higher than the target temperature thereof, at a step SA4 shown in FIG. 10, the controller 70 controls the fixing heater 53 to decrease the power W to be supplied. The controller 70 sets the new power W to be supplied to the fixing heater 53 so as to be (G−$\alpha$) W when the detected temperature of the fixing heater 53 is higher than the target temperature thereof and the supplied power W is G.

At a step SA5 shown in FIG. 10, the controller 70 controls the voltage detection unit 57 to obtain a voltage value to be applied to the fixing heater 53 by the alternating current power supply AC. In this embodiment, the voltage detection unit 57 detects the voltage value applied across both terminals of the fixing heater 53 by the alternating current power supply AC. Alternatively, the controller 70 refers to the voltage values V of the alternating current power supply AC that a service man or the like manually sets.

At a step SA6 shown in FIG. 10, the controller 70 determines the heater turn-on duty X % to be used on the basis of the power W supplied to the fixing heater, which is obtained in the above-mentioned step SA3 or SA4, and the voltage V applied to the fixing heater 53, which is obtained in the above-mentioned step SA5. At a step SA7 shown in FIG. 10, the controller 70 performs the above-mentioned algorithm or refers to the table produced according to the above-mentioned algorithm and produces the control pattern corresponding to the heater turn-on duty determined at the step SA6 based on the combination of the control patterns corresponding to the above-mentioned standard. The controller 70 then controls the switching unit 54 to switch from the off-state to the on-state and vice versa based on the control pattern corresponding to the heater turn-on duty to be used during a predetermined control period of time.

When the controller 70 controls the switching unit 54 to switch from the off-state to the on-state and vice versa based on the control patterns shown in FIGS. 8A through 8L, the controller 70 controls the fixing apparatus 50 so that the power is supplied to the fixing heater 53 in order that the heater turn-on duty is smaller among the combinations of control patterns corresponding to the heater turn-on duty. For example, when the heater turn-on duty to be used during the one control period of time is 4%, the control patter of the pattern 1 is 1/11, the control patter of the pattern 2 is 0/11 and the control patter of the pattern 3 is 0/3. In this case, the power is supplied to the fixing heater 53 in order of the pattern 2, the pattern 3 and the pattern 1. Alternatively, the power may be supplied to the fixing heater 53 in order of the pattern 3, the pattern 2 and the pattern 1. This prevents inrush current based on sudden increase of the heater turn-on duty.

When the denomination of the fraction representing the heater turn-on duty to be used is 50 or less, the power is repeatedly supplied to the fixing heater 53 during one control period of time. For example, when the heater turn-on duty to be used during the one control period of time is 4%, the power is repeatedly supplied four times to the fixing heater 53 based on the combination of the pattern 2, the pattern 3 and the pattern 1 in this order or the combination of the pattern 3, the pattern 2 and the pattern 1 in this order.

At a step SA8 shown in FIG. 10, the controller 70 finishes the temperature control process of the fixing heater 53 when receiving indication to finish the temperature control process thereof. The controller 70 continues the operations from the step SA1 when receiving no indication to finish the temperature control process thereof.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

Although the image forming apparatus according to the embodiments of the invention has been described, the invention is not limited to these embodiments, and many kinds of variation are available within a range of the invention. Although the controller of the image forming apparatus has been able to be used as the controller for controlling the fixing apparatus in the embodiments, the fixing apparatus can include its controller separately that performs the above-mentioned temperature control operations.

What is claimed is:

1. A fixing apparatus comprising:

a fixing heater that performs heat fixing;

a control unit that controls the fixing heater based on control patterns in each of which turn-on period of the fixing heater and turn-off period of the fixing heater are set according to a control cycle with a half cycle of alternate current supplied from alternate current power supply being as one unit;

a temperature-detecting unit that detects temperature of the fixing heater; and a voltage-value-acquiring unit that acquires a voltage value that is applied to the fixing heater, wherein the control unit is configured so as to turn the fixing heater on or off using a combination of the control patterns each satisfying a predetermined standard during each control period of time that is integral multiplication of the control cycle according to the temperature of the fixing heater detected by the temperature-detecting unit and the voltage value, which is allied to the fixing heater, acquired by the voltage-value-acquiring unit.

2. The fixing apparatus according to claim 1, wherein by an algorithm in which a heater turn-on duty by which power to be supplied to the fixing heater during each control period of time is determined is represented as a fraction;

a denominator of the fraction representing the heater turn-on duty is represented using sum of designated odd numbers so that number of term thereof is fewest; and a numerator is selected so that maximum number of the heater turn-on duty becomes smallest among combinations of the denominator and the numerator which satisfy the predetermined standard, the combination of the control patterns corresponding to the heater turn-on duty, in which the denominator represents numbers of the control cycles and the numerator represents numbers of turn-on of the fixing heater, is formed.

3. The fixing apparatus according to claim 1, wherein the combination of the control patterns corresponding to a heater turn-on duty is selected by referring to a table which stores the combination of the control patterns in each of which the denominator represents number of the control cycle and the numerator represents number of turn-on of the fixing heater, the control patterns being produced by an algorithm in which heater turn-on duty by which power to be supplied to the fixing heater during each control period of time is determined is represented as a fraction;

a denominator of the fraction representing the heater turn-on duty is represented using sum of designated odd numbers so that number of term is fewest; and a numerator is selected so that maximum number of the heater turn-on duty becomes smallest among combinations of the denominator and the numerator which satisfy the predetermined standard.

4. The fixing apparatus according to claim 2 wherein the fixing heater repeats to changeably turns on or off one or more times in the control period of time according to the control patterns in order that the heater turn-on duty is smaller among the combination of the control patterns corresponding to the heater turn-on duty to be used.

5. The fixing apparatus according to claim 3 wherein the fixing heater repeats to changeably turns on or off one or more times in the control period of time according to the control patterns in order that the heater turn-on duty is smaller among the combination of the control patterns corresponding to the heater turn-on duty to be used.

6. The fixing apparatus according to claim 1 wherein the voltage-value-acquiring unit includes a voltage detection portion that detects voltage applied to the fixing heater, and a heater turn-on duty by which power to be supplied to the fixing heater is determined is changed on the basis of the voltage detected by the voltage detection portion.

7. The fixing apparatus according to claim 1 wherein the voltage-value-acquiring unit includes a voltage-setting portion that sets voltage applied to the fixing heater, and a heater turn-on duty by which power to be supplied to the fixing heater is determined is changed on the basis of the voltage set by the voltage-setting portion.

8. An image-forming apparatus comprising:

an image-forming unit that transfers an image on a sheet; and a fixing apparatus that fixes the image transferred by the image-forming unit on the sheet, the fixing apparatus including:

a fixing heater that performs heat fixing;

a control unit that controls the fixing heater based on control patterns in each of which turn-on period of the fixing heater and turn-off period of the fixing heater are set according to a control cycle with a half cycle of alternate current supplied from alternate current power supply being as one unit;

a temperature-detecting unit that detects temperature of the fixing heater; and a voltage-value-acquiring unit that acquires a voltage value that is applied to the fixing heater, wherein the control unit is configured so as to turn the fixing heater on or off using a combination of the control patterns each satisfying a predetermined standard during each control period of time that is integral multiplication of the control cycle according to the temperature of the fixing heater detected by the temperature-detecting unit and the voltage value, which is allied to the fixing heater, acquired by the voltage-value-acquiring unit.

* * * * *